US009592891B2

(12) United States Patent
Kimura et al.

(10) Patent No.: US 9,592,891 B2
(45) Date of Patent: Mar. 14, 2017

(54) FLUID TRANSFER DEVICE, SHIP INCLUDING THE SAME, AND FLUID FOR USE IN TRANSFER DEVICE

(75) Inventors: Akira Kimura, Kobe (JP); Teruo Kishimoto, Kakogawa (JP); Takahiro Toyoura, Kobe (JP)

(73) Assignee: KAWASAKI JUKOGYO KABUSHIKI KAISHA, Kobe-Shi (JP)

( * ) Notice: Subject to any disclaimer, the term of this patent is extended or adjusted under 35 U.S.C. 154(b) by 718 days.

(21) Appl. No.: 13/995,288

(22) PCT Filed: Dec. 16, 2011

(86) PCT No.: PCT/JP2011/007034

§ 371 (c)(1),
(2), (4) Date: Jun. 18, 2013

(87) PCT Pub. No.: WO2012/086165

PCT Pub. Date: Jun. 28, 2012

(65) Prior Publication Data

US 2013/0269803 A1 Oct. 17, 2013

(30) Foreign Application Priority Data

Dec. 20, 2010 (JP) ..... 2010-282755

(51) Int. Cl.
*B63B 39/02* (2006.01)
*F04B 43/067* (2006.01)
(Continued)

(52) U.S. Cl.
CPC ..... *B63B 39/02* (2013.01); *B63B 39/03* (2013.01); *B63B 43/06* (2013.01); *F04B 9/109* (2013.01);
(Continued)

(58) Field of Classification Search
CPC . B63B 39/03; B63B 43/06; Y10T 137/86187; F04B 43/067; F04B 43/073
See application file for complete search history.

(56) References Cited

U.S. PATENT DOCUMENTS 2,017,072 A * 10/1935 Minorsky ..... B63B 39/03 114/122
2,066,150 A * 12/1936 Hort ..... B63B 39/14 114/125
(Continued)

FOREIGN PATENT DOCUMENTS

DE 102 40 602 A1 3/2004
JP A-56-124689 9/1981
(Continued)

OTHER PUBLICATIONS

Feb. 2, 2015 Office Action issued in Chinese Patent Application No. 201180054618.0.
(Continued)

*Primary Examiner* — Atif Chaudry
(74) *Attorney, Agent, or Firm* — Oliff PLC

(57) ABSTRACT

The present invention includes: first and second tanks and each configured to store a fluid containing fine powder; a communication pipe through which the first and second tanks and communicate with each other; and a transfer portion configured to transfer the fluid stored in a desired one of the first and second tanks to the other tank. Each of the tanks and includes a first chamber and a second chamber that are separated by a deformable dividing wall. Each of the first chambers stores an incompressible fluid, and each of the second chambers stores the fluid having higher specific gravity and viscosity than the incompressible fluid. The second chambers of the first and second tanks communicate with each other through the communication pipe. When the
(Continued)

incompressible fluid is supplied to the desired first chamber, the transfer portion can discharge the incompressible fluid from the other first chamber.

5 Claims, 2 Drawing Sheets

(51) Int. Cl.

| | |
|---|---|
| ***F04B 43/073*** | (2006.01) |
| ***B63B 39/03*** | (2006.01) |
| ***B63B 43/06*** | (2006.01) |
| ***F04B 9/109*** | (2006.01) |
| ***F04B 9/117*** | (2006.01) |
| ***F04B 43/12*** | (2006.01) |
| ***F04B 15/02*** | (2006.01) |

(52) U.S. Cl.
CPC ..... *F04B 9/117* (2013.01); *F04B 15/02* (2013.01); *F04B 43/067* (2013.01); *F04B 43/073* (2013.01); *F04B 43/1253* (2013.01); *F04B 43/1261* (2013.01); *Y10T 137/86187* (2015.04)

(56) References Cited

U.S. PATENT DOCUMENTS

| | | | | | |
|---|---|---|---|---|---|
| 2,906,230 | A * | 9/1959 | Salomon | B63B 39/04 | 114/125 |
| 3,306,247 | A * | 2/1967 | Fanshawe | B63B 39/03 | 114/125 |
| 3,343,511 | A * | 9/1967 | Hinton | B63G 8/26 | 114/330 |
| 3,452,705 | A * | 7/1969 | Bell | B63B 39/03 | 114/125 |
| 3,580,205 | A * | 5/1971 | Bell | B63B 39/03 | 114/125 |
| 3,689,953 | A * | 9/1972 | Markakis | E01D 15/14 | 114/125 |
| 3,698,345 | A * | 10/1972 | Kreitner | B63B 39/03 | 114/125 |
| 3,704,595 | A * | 12/1972 | Launay | E02D 23/16 | 14/75 |
| 3,741,145 | A * | 6/1973 | Braddon | B63B 43/06 | 114/125 |
| 3,886,886 | A * | 6/1975 | Anders | B63B 35/4413 | 114/125 |
| 3,949,693 | A * | 4/1976 | Bauer | B63B 35/4413 | 114/124 |
| 4,007,700 | A * | 2/1977 | Haynes | B63B 35/28 | 114/74 T |
| 4,207,828 | A * | 6/1980 | Horowitz | B63B 43/06 | 114/125 |
| 4,662,386 | A * | 5/1987 | Pedersen | B65D 88/78 | 137/236.1 |
| 4,715,309 | A * | 12/1987 | Liberg | B63B 43/06 | 114/125 |
| 4,854,832 | A * | 8/1989 | Gardner | F04B 43/0736 | 417/393 |
| 4,919,067 | A * | 4/1990 | Wenstob | B63C 7/003 | 114/121 |
| 5,232,352 | A * | 8/1993 | Robinson | F04B 43/0736 | 417/393 |
| 5,249,933 | A * | 10/1993 | Moody | F01L 25/08 | 114/312 |
| 5,277,555 | A * | 1/1994 | Robinson | F01L 25/063 | 137/625.37 |
| 5,309,857 | A * | 5/1994 | Brosseuk | B63B 43/06 | 114/125 |
| 5,349,915 | A * | 9/1994 | Thomas | B63G 8/26 | 114/124 |
| 6,857,155 | B2 * | 2/2005 | Yorigami | E01D 15/14 | 114/266 |
| 7,984,685 | B1 * | 7/2011 | Buescher | B63B 22/20 | 114/121 |
| 2004/0148715 | A1 * | 8/2004 | Yorigami | E01D 15/14 | 14/27 |

FOREIGN PATENT DOCUMENTS

| | | |
|---|---|---|
| JP | A-57-51596 | 3/1982 |
| JP | U-60-165294 | 11/1985 |
| JP | A-7-101385 | 4/1995 |
| JP | H10-281058 A | 10/1998 |
| JP | A-2000-2189 | 1/2000 |
| JP | A-2001-73929 | 3/2001 |
| JP | U-3100447 | 1/2004 |

OTHER PUBLICATIONS

Mar. 13, 2012 International Search Report issued in International Patent Application No. PCT/JP2011/007034.

* cited by examiner

FLUID TRANSFER DEVICE, SHIP INCLUDING THE SAME, AND FLUID FOR USE IN TRANSFER DEVICE

TECHNICAL FIELD

The present invention relates to a fluid transfer device, a ship including the fluid transfer device, and a fluid for use in the transfer device, the fluid transfer device being configured to transfer, for example, a fluid of high specific gravity containing fine powder of high specific gravity, and particularly, capable of moving the position of the center of gravity of a ship (such as a submersible vessel), a vehicle, a structure, or the like.

BACKGROUND ART

One example of conventional fluid transfer devices is shown in FIG. 2 (see PTL 1, for example). As shown in FIG. 2, a fluid transfer device 1 includes: first and second tanks 3 and 4 each configured to store a fluid 2 containing fine powder; a pipe 5 configured to cause the first tank 3 and the second tank 4 to communicate with each other and including a flexible tube portion 5*a* partially having flexibility; and roller portions 6 capable of rotating in both forward and backward directions and configured to rotate and press the flexible tube portion 5*a* to cause the fluid 2 in the flexible tube portion 5*a* to move in the forward or backward direction.

As shown in FIG. 2, the roller portions 6 are respectively provided at both end portions of a revolving arm 7. The flexible tube portion 5*a* is arranged along an inner surface of a U-shaped cross section of a recess 8*a* formed in a housing 8.

According to the fluid transfer device 1, by causing the revolving arm 7 to rotate in a desired direction, the roller portions 6 rotate and press the flexible tube portion 5*a*. Thus, the fluid 2 in the flexible tube portion 5*a* can be caused to move in the desired forward or backward direction. With this, the fluid 2 in a desired one of the first and second tanks 3 and 4 can be transferred to the other tank.

To be specific, according to the conventional fluid transfer device 1 shown in FIG. 2, the roller portions 6 rotate and press the flexible tube portion 5*a* to cause the fluid 2 in the flexible tube portion 5*a* to move in the desired direction. In addition, when the application of a pressing force of the roller portions 6 to the flexible tube portion 5*a* stops, the flexible tube portion 5*a* having a flat shape by the pressing is restored to, for example, an original circular cross section by its elastic force. Then, when the flexible tube portion 5*a* is restored to the original shape, the subsequent fluid 2 moves into the flexible tube portion 5*a* having the original shape.

CITATION LIST

Patent Literature

PTL 1: Japanese Laid-Open Patent Application Publication No. 2000-2189

SUMMARY OF INVENTION

Technical Problem

However, according to the conventional fluid transfer device 1 shown in FIG. 2, when the application of the pressing force of the roller portions 6 to the flexible tube portion 5*a* stops, it takes a certain amount of time for the flexible tube portion 5*a* having the flat shape by the pressing to return to the original circular cross section by the elastic force. Therefore, a time it takes for the subsequent fluid 2 to move into the flexible tube portion 5*a* from which the fluid 2 has been pushed out depends on the restoring speed of the flexible tube portion 5*a*.

On this account, even if the rotating speed of the roller portions 6 is increased in order to increase a transfer flow rate for transferring the fluid 2 in one of the tanks 3 and 4 to the other tank, the required transfer flow rate may not be obtained.

Then, since the restoring force of the flexible tube portion 5*a* varies, the transfer flow rate of the fluid 2 also varies, so that the high flow rate accuracy cannot be obtained.

In addition, since the transfer flow rate decreases by the decrease in the restoring force of the flexible tube portion 5*a*, the development of the fluid transfer device having excellent durability is desired.

The present invention was made to solve the above problems, and an object of the present invention is to provide a fluid transfer device, a ship including the fluid transfer device, and a fluid for use in the transfer device, the fluid transfer device being capable of quickly transferring a fluid, stored in a desired one of two tanks and having high specific gravity and viscosity, to the other tank with high flow rate accuracy and having excellent durability.

Solution to Problem

A fluid transfer device according to the present invention includes: first and second tanks each configured to store a fluid containing fine powder; a communication pipe through which the first and second tanks communicate with each other; and a transfer portion configured to transfer the fluid stored in the first tank to the second tank and transfer the fluid stored in the second tank to the first tank, wherein: each of the first and second tanks includes a first chamber and a second chamber that are separated by a deformable dividing wall; each of the first chambers stores an incompressible fluid; each of the second chambers stores the fluid having higher specific gravity and viscosity than the incompressible fluid; the second chambers of the first and second tanks communicate with each other through the communication pipe; and when the transfer portion supplies the incompressible fluid to a desired one of the first chambers, the incompressible fluid is discharged from the other first chamber.

According to the fluid transfer device of the present invention, as the transfer portion supplies the incompressible fluid to the first chamber of the first tank, the volume of the incompressible fluid in the first chamber of the first tank increases. As the volume of the incompressible fluid in the first chamber of the first tank increases, the dividing wall deforms to move from the first chamber side to the second chamber side, so that the volume of the second chamber of the first tank decreases. With this, the fluid stored in the second chamber of the first tank can be transferred to the second chamber of the second tank through a connecting pipe. At this time, as the volume of the fluid in the second chamber of the second tank increases, the dividing wall of the second tank deforms to move from the second chamber side to the first chamber side, so that the volume of the first chamber of the second tank decreases. With this, the incompressible fluid stored in the first chamber of the second tank is discharged therefrom, As above, the fluid having higher specific gravity than the incompressible fluid is transferred form the second chamber of a desired one of two tanks to the second chamber of the other tank. With this, the position of the center of gravity of the two tanks can be moved from the desired tank side to the other tank side.

Since the incompressible fluid has lower specific gravity and viscosity than the fluid, the transfer portion can efficiently supply the incompressible fluid to the first chamber of each tank and discharge the incompressible fluid from the first chamber of each tank. Therefore, the fluid having high specific gravity and viscosity and stored in the second chamber of a desired one of two tanks can be efficiently transferred to the second chamber of the other tank.

Since the first chamber and the second chamber are separated by the deformable dividing wall, the fluid and the incompressible fluid in each tank do no mix with each other. Therefore, the position of the center of gravity of the two tanks can be accurately moved to a desired tank side.

Further, the fluid has higher viscosity than the incompressible fluid. Therefore, the fine powder contained in the fluid and having high specific gravity can be prevented from settling out in the fluid, and the variations in the specific gravity in the fluid can be reduced. On this account, the weight accuracy of the fluid to be moved and the movement accuracy of the position of the center of gravity of the two tanks can be improved.

In the fluid transfer device according to the present invention, a stirring device configured to stir the fluid in the communication pipe may be provided on the communication pipe.

With this, the fluid transferred through the communication pipe can be stirred. Therefore, the stirring device can evenly stir the substantially entire fluid stored in the two tanks. With this, the stirring device can quickly, appropriately disperse the fine powder of high specific gravity contained in the fluid to prevent the fine powder from settling out. By appropriately dispersing the fine powder, variations in the specific gravity and viscosity in the fluid can be reduced. By reducing the variations in the viscosity, the fluid can be stably, smoothly transferred.

In the fluid transfer device according to the present invention, the stirring device may be a uniaxial eccentric screw pump.

With this, the fluid flowing through the communication pipe can be stirred, and the transfer force can be generated based on the ejecting pressure of the uniaxial eccentric screw pump. With this, the energy required by the transfer portion to supply the incompressible fluid to the first chamber of each tank and discharge the incompressible fluid from the first chamber of each tank can be reduced.

In the fluid transfer device according to the present invention, a pressure adjuster may be provided at the stirring device or the communication pipe, and the pressure adjuster may include a cylinder portion configured to cause an inner side and outer side of the stirring device or the communication pipe to communicate with each other, a piston portion provided in the cylinder portion, and a biasing unit configured to bias the piston portion such that pressure in the stirring device or the communication pipe increases.

With this, when, for example, an external pressure P1 is being applied to an outer surface of the stirring device or communication pipe, a pressure P3 (=P1+P2) that is the sum of the external pressure P1 and the pressure P2 that is based on the biasing force of the biasing unit is applied to the piston portion. Then, the pressure P3 applied to the piston portion is transmitted to the fluid in the stirring device or communication pipe. As a result, the pressure of the fluid in the stirring device or communication pipe becomes the pressure P3. A differential pressure between the pressure P3 of the fluid and the external pressure P1 is denoted by P2 (=P1+P2−P1). The differential pressure P2 (set pressure) is based on the biasing force of the biasing unit and does not contain the external pressure P1. Therefore, even if the external pressure P1 changes, the differential pressure P2 that is constant can prevent a gas or a liquid, such as outside seawater, from getting into the stirring device or the communication pipe, and therefore, the tanks. On this account, the fluid can be surely transferred, and the position of the center of gravity of the two tanks can be accurately moved.

Similarly, even in a case where the stirring device, the communication pipe, and the tanks contract or expand by, for example, an ambient temperature change, the pressure adjuster can adjust the pressure P3 in the stirring device or communication pipe such that the pressure P3 becomes higher than the external pressure P1 by the predetermined set pressure P2. With this, the same effects as above can be obtained.

In the fluid transfer device according to the present invention, the fluid may be prepared by mixing metal fine powder and one of a semisolid and a paste, the specific gravity of the fluid may be 5 to 9, and a weight ratio of the semisolid or paste to the metal fine powder may be 15:85 to 5:95.

Since the fluid is prepared by mixing the semisolid or paste of high viscosity with the metal fine powder as above, the metal fine powder can be adequately prevented from settling out in the semisolid or paste, and variations in the specific gravity and viscosity in the fluid can be reduced.

By adopting the metal fine powder, the fluid having the specific gravity of 5 to 9 can be prepared. For example, in a case where the fluid transfer device is applied to a submersible vessel that is small in the entire length, attitude control, such as front-rear inclination or left-right inclination, of the vessel can be performed by setting the specific gravity of the fluid to 5 or more.

In addition, since the weight ratio of the semisolid or paste to the metal fine powder is set to 15:85 to 5:95, the metal fine powder in the semisolid or paste can be prevented from settling out. As a result, as described above, the attitude control of the vessel can be performed, and the flowability of the fluid can be secured such that the fluid can move between the two tanks.

In the fluid transfer device according to the present invention, the metal fine powder may be tungsten metal whose particle diameter is 10 to 150 μm, and the semisolid or paste is lithium grease.

As above, by adopting the metal fine powder whose particle diameter is 10 to 150 μm, the fluid of high specific gravity can be prepared.

To be specific, if the particle diameter is smaller than 10 μm, the aggregation of the fine powder easily occurs. Since gaps are formed among the aggregates of the fine powder, the specific gravity of the fluid cannot be increased. If the particle diameter exceeds 150 μm, gaps among the fine powder particles are large, so that the specific gravity of the fluid cannot be increased.

The tungsten metal is used as the metal fine powder, and the lithium grease is used as the semisolid or paste, so that the fluid can be provided, which is high in the specific gravity, is stable at normal temperature under atmospheric pressure environment, hardly influences human bodies and nature, and is inexpensive.

A ship according to the present invention includes the fluid transfer device according to the present invention.

According to the ship including the fluid transfer device of the present invention, the fluid transfer device included in the ship acts as explained in the fluid transfer device according to the present invention.

A fluid for use in a transfer device according to the present invention is a fluid for use in a fluid transfer device, the fluid transfer device including: first and second tanks each configured to store a fluid containing fine powder; a communication pipe through which the first and second tanks communicate with each other; and a transfer portion configured to transfer the fluid stored in the first tank to the second tank and transfer the fluid stored in the second tank to the first tank, wherein: the fluid is prepared by mixing metal fine powder and one of a semisolid and a paste; a specific gravity of the fluid is 5 to 9; and a weight ratio of the semisolid or paste to the metal fine powder is 15:85 to 5:95.

According to the fluid for use in the transfer device of the present invention, by using the fluid in the fluid transfer device, the fluid acts as explained in the fluid transfer device according to the present invention.

In the fluid for use in the transfer device according to the present invention, the metal fine powder may be tungsten metal whose particle diameter is 10 to 150 μm, and the semisolid or paste may be lithium grease.

With this, the fluid acts as explained in the fluid transfer device according to the present invention.

Advantageous Effects of Invention

Since the fluid transfer device according to the present invention is configured as above, the fluid having higher specific gravity and viscosity than the incompressible fluid can be quickly transferred from the second chamber of a desired one of two tanks to the second chamber of the other tank with high flow rate accuracy.

Therefore, for example, in a case where the fluid transfer device is used in a ship, such as a submersible vessel, the attitude control can be performed by quickly, accurately moving the position of the center of gravity of the submersible vessel or the like. One example of the attitude control is the front-rear inclination performed when the submersible vessel submerges or rises. The front-rear inclination is quickly performed to realize a correct inclination angle. With this, the submersible vessel can quickly submerge or rise by using a small amount of propulsive power generated by a propulsive driving portion.

Another example of the attitude control is the left-right inclination caused by transportable heavy loads (burdens and the like), crew members, and the like in a ship, such as a submersible vessel. The left-right inclination of the ship is performed quickly to realize a correct inclination angle. With this, the left-right balance of the ship can be quickly, safely adjusted.

Further, when the fluid is transferred, the deformable dividing walls provided in the two tanks deform by receiving the pressure of the incompressible fluid. Since the dividing wall is not configured to deform by pressing a hard member against a part of the dividing wall, the life of the dividing wall to be deformed can be extended. As a result, the fluid transfer device having excellent durability can be provided.

By supplying the incompressible fluid of comparatively low viscosity to the first chambers of the tanks and discharging the incompressible fluid from the first chambers of the tanks, the fluid of comparatively high viscosity stored in the second chamber via the dividing wall is transferred. Therefore, the energy used for the transfer can be made smaller than, for example, a case where the fluid of comparatively high viscosity is directly transferred by using a pump.

To move the position of the center of gravity of the submersible vessel or the like as above, it is effective to use mercury as the fluid since the mercury has high specific gravity. However, by using the fluid of high specific gravity containing the fine powder of high specific gravity according to the present invention, the position of the center of gravity can be quickly, surely moved without using the mercury.

In a case where the fluid for use in the transfer device according to the present invention is used in the fluid transfer device as above, the same effects as above can be obtained.

DESCRIPTION OF EMBODIMENTS

Hereinafter, a fluid transfer device and a fluid for use in the transfer device according to one embodiment of the present invention will be explained in reference to FIG. 1. A fluid transfer device 11 is configured to transfer a fluid 12 of high specific gravity containing fine powder of high specific gravity and is particularly capable of moving the position of the center of gravity of a ship (such as a submersible vessel), a vehicle, a structure, or the like. The present embodiment will explain an example in which the fluid transfer device 11 is applied to a submersible vessel that is a ship.

Figure 1:
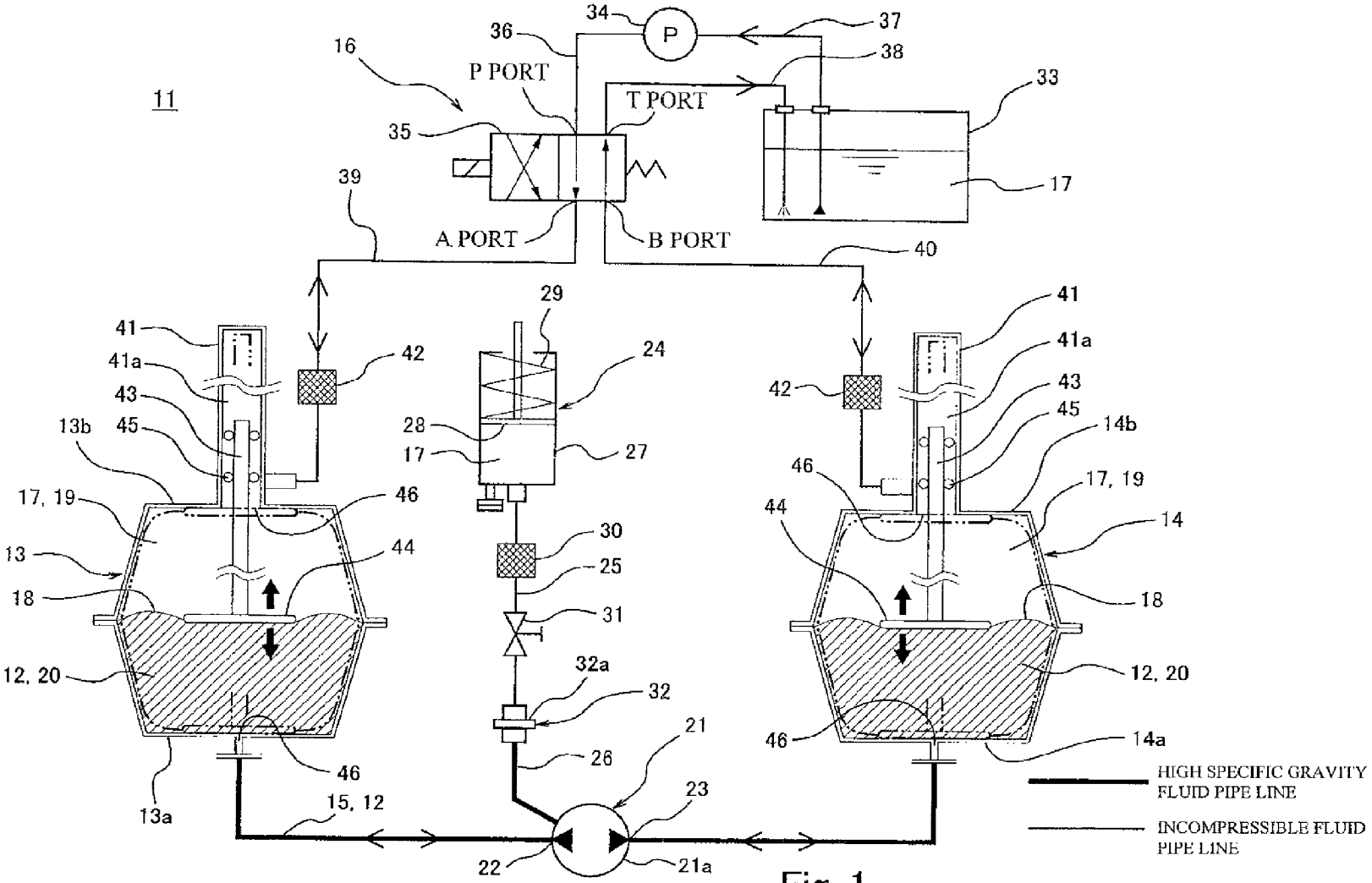
FIG. 1 is a cross-sectional view showing a fluid transfer device according to one embodiment of the present invention, the fluid transfer device being included in a submersible vessel.
Figure 2:
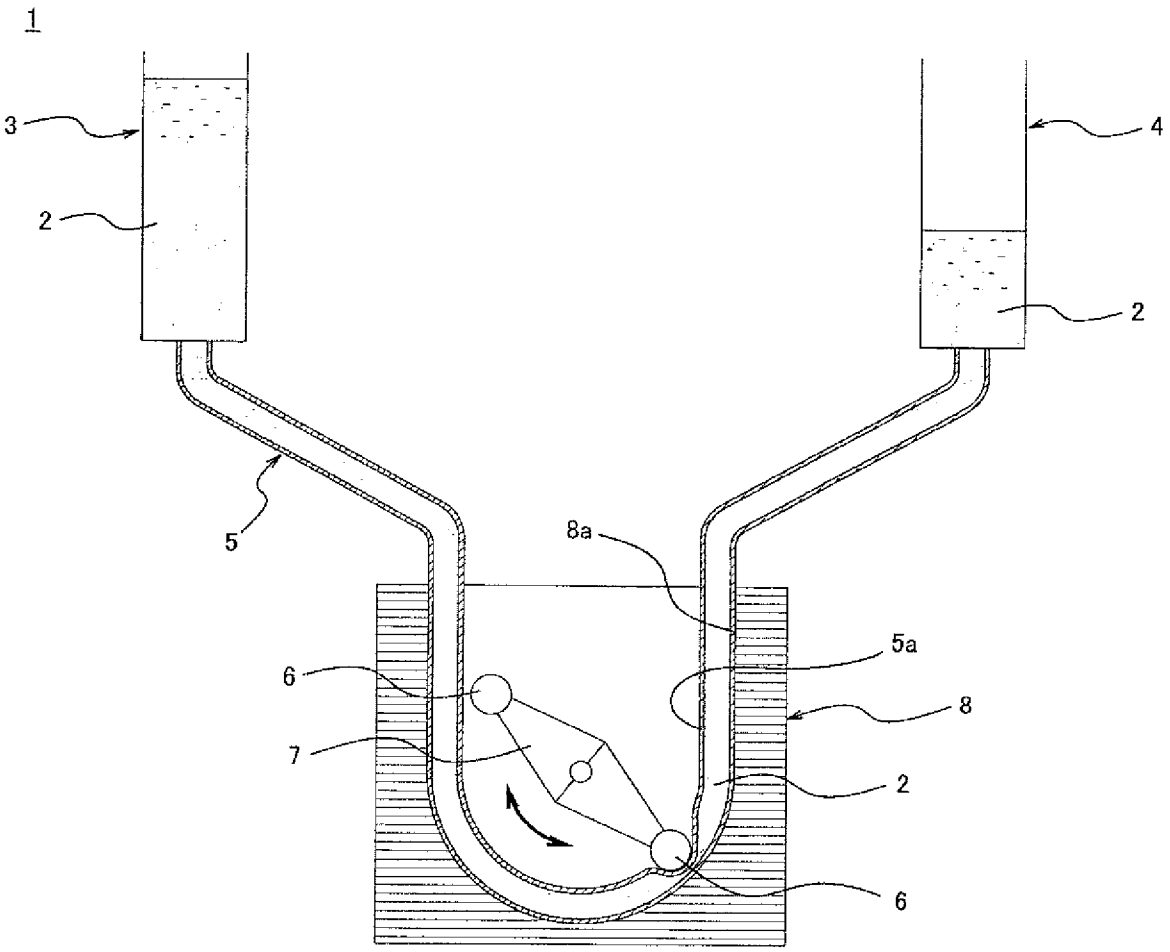
FIG. 2 is a cross-sectional view showing a conventional fluid transfer device.

FIG. 1 is a cross-sectional view showing the fluid transfer device 11 included in the submersible vessel. The fluid transfer device 11 includes: a first tank 13 and a second tank 14, each configured to store the fluid 12 of high specific gravity containing the fine powder of high specific gravity; a communication pipe 15 through which the first and second tanks 13 and 14 communicate with each other; and a transfer portion 16 capable of transferring the fluid 12 stored in the first tank 13 to the second tank 14 and transferring the fluid 12 stored in the second tank 14 to the first tank 13.

As above, by transferring the fluid 12 of high specific gravity, the position of the center of gravity of the fluid transfer device 11, and therefore, the submersible vessel can be moved by a desired distance. With this, the attitude control of the submersible vessel can be performed.

In FIG. 1, a pipe line shown by a thick line is a high specific gravity fluid pipe line. The high specific gravity fluid pipe line is a pipe in which the fluid 12 of high specific gravity is stored. Then, a pipe line shown by a thin line is an incompressible fluid pipe line. The incompressible fluid pipe line is a pipe in which an incompressible fluid 17 of low specific gravity is stored.

The first and second tanks 13 and 14 shown in FIG. 1 are the same as each other. Therefore, the first tank 13 on the left side in FIG. 1 will be explained, and an explanation of the second tank 14 on the right side is omitted.

As shown in FIG. 1, the first tank 13 has a barrel shape whose body portion bulges. The first tank 13 includes a first chamber 19 and a second chamber 20 formed by dividing the first tank 13 into upper and lower sides by a dividing wall 18 in a sealed state, the dividing wall 18 being made of, for example, synthetic rubber and deformable.

The first chamber 19 on the upper side stores the incompressible fluid 17, and the second chamber 20 on the lower side stores the fluid 12 of high specific gravity. The incompressible fluid 17 is a liquid, such as oil or water. As described below, the fluid 12 is higher in the specific gravity and viscosity than the incompressible fluid 17 and is the fluid 12 of high specific gravity containing the fine powder of high specific gravity.

The dividing wall 18 is made of synthetic rubber that is deformable and has flexibility. When the amount of incompressible fluid 17 stored in the first chamber 19 and the amount of fluid 12 stored in the second chamber 20 are substantially the same as each other, the dividing wall 18 has a substantially flat shape and is arranged substantially horizontally as shown by a solid line in FIG. 1. When the fluid 12 stored in the second chamber 20 of the first tank 13 (or the second tank 14) is transferred to the second chamber 20 of the second tank 14 (or the first tank 13), the dividing walls 18 in the first and second tanks 13 and 14 respectively become a cup shape and an inverted cup shape (or a substantially inverted cup shape and a substantially cup shape) as shown by chain double-dashed lines in FIG. 1. To be specific, the dividing wall 18 is formed such that an original shape thereof before the deformation is a cup shape.

Therefore, in a state where the dividing wall 18 shown in FIG. 1 has a substantially flat shape and is arranged substantially horizontally, an annular portion thereof along an inner peripheral surface of each of the first and second tanks 13 and 14 is bent, although not shown.

As shown in FIG. 1, the second chambers 20 of the first and second tanks 13 and 14 are couple to and communicate with each other through the communication pipe 15. Both end portions of the communication pipe 15 are respectively coupled to bottom walls 13*a* and 14*a* of the second chambers 20. The fluid 12 stored in the second chamber 20 of the first tank 13 or the second tank 14 is transferred through the communication pipe 15 to the second chamber 20 of the second tank 14 or the first tank 13. A stirring device 21 is provided on a substantially middle portion of the communication pipe 15.

The stirring device 21 can stir the fluid 12 in the communication pipe 15. The stirring device 21 can disperse the fine powder, contained in the fluid 12 of high specific gravity, in the fluid 12 to prevent the fine power from settling out. The stirring device 21 is, for example, a uniaxial eccentric screw pump.

The uniaxial eccentric screw pump can transfer the fluid 12 of high viscosity (for example, a semisolid or paste containing fine powder). As shown in FIG. 1, the uniaxial eccentric screw pump includes a first opening portion 22 serving as a suction port or a discharge port and a second opening portion 23 serving as a discharge port or a suction port. The first and second opening portions 22 and 23 are respectively coupled to intermediate end portions of the communication pipe 15.

Although not shown, the uniaxial eccentric screw pump includes a rotor and a stator. For example, the rotor is driven by an electric motor and rotates in both forward and backward directions. The stator is fixed to a fixed portion, and the rotor is rotatably attached to an inner hole of the stator.

When the rotor rotates in the forward direction (or in the backward direction), the uniaxial eccentric screw pump can suction the fluid 12 through the first opening portion 22 (or the second opening portion 23) and discharge the fluid 12 through the second opening portion 23 (or the first opening portion 22). By the rotation of the rotor, the fluid 12 can be stirred, so that the fine powder contained in the fluid 12 can be dispersed in the fluid 12. As above, the stirring device 21 can transfer the fluid 12 while stirring the fluid 12.

The stirring device 21 can stir the fluid 12 transferred through the communication pipe 15 shown in FIG. 1. Therefore, the stirring device 21 can evenly stir the substantially entire fluid 12 of high specific gravity stored in the first and second tanks 13 and 14. With this, the stirring device 21 can quickly, appropriately disperse the fine powder contained in the fluid 12 to prevent the fine powder from settling out. By appropriately dispersing the fine powder, variations in the specific gravity and viscosity in the fluid 12 can be reduced. By reducing the variations in the viscosity, the fluid 12 can be stably, smoothly transferred.

Next, a pressure adjuster 24 shown in FIG. 1 will be explained. In a case where the stirring device 21, the communication pipe 15, the first tank 13, the second tank 14, and the like are provided outside the submersible vessel, the pressure adjuster 24 adjusts internal pressures of the stirring device 21, the communication pipe 15, the first tank 13, the second tank 14, and the like such that each of the internal pressures becomes higher than the pressure of outside seawater (external pressure that is depth pressure) by a certain pressure (differential pressure).

As shown in FIG. 1, the pressure adjuster 24 includes a cylinder portion 27. The cylinder portion 27 causes the inner side and outer side (seawater side, for example) of the stirring device 21 to communicate with each other through a first pressure adjusting pipe 25 and a second pressure adjusting pipe 26.

The inner side of the stirring device 21 denotes a space formed by an outer surface of the rotor and an inner surface of the stator in the uniaxial eccentric screw pump included in the stirring device 21. This space can store the fluid 12, and by the rotation of the rotor, the fluid 12 is transferred from the first opening portion 22 (or the second opening portion 23) side to the second opening portion 23 (or the first opening portion 22) side. Since the fluid 12 is transferred as above, it is stirred.

A piston portion 28 is attached to the inside of the cylinder portion 27 so as to be slidable in a front-rear direction, and a biasing unit 29 (for example, a compression coil spring) configured to bias the piston portion 28 in such a direction that the pressure in the stirring device 21 increases is provided at the piston portion 28.

As shown in FIG. 1, a filter 30 and a master valve 31 are provided on the first pressure adjusting pipe 25, and a pressure transducer 32 is provided on the second pressure adjusting pipe 26.

The pressure transducer 32 is configured such that a dividing wall (not shown) made of synthetic rubber having flexibility is provided in an outer case 32*a* shown in FIG. 1. The dividing wall separates in a sealed state the incompressible fluid 17, such as oil or water, stored in the first pressure adjusting pipe 25 and the fluid 12 stored in the second pressure adjusting pipe 26. In addition, the dividing wall can receive the pressure from the incompressible fluid 17 side and the pressure from the fluid 12 side and transmits the pressure to the fluid 12 side and the incompressible fluid 17 side.

Next, the actions of the pressure adjuster 24 will be explained. According to the pressure adjuster 24, for example, when an external pressure P1 is being applied to an outer surface of an exterior portion 21*a* of the stirring device 21, a pressure P3 (=P1+P2) that is the sum of the external pressure P1 and a pressure P2 that is based on the biasing force of the biasing unit 29 (compression coil spring) is applied to the piston portion 28. Then, the pressure P3 applied to the piston portion 28 is transmitted to the fluid 12 stored in the space in the stirring device 21. As a result, the pressure of the fluid 12 in the space in the stirring device 21 becomes the pressure P3. A differential pressure between the pressure P3 of the fluid 12 and the external pressure P1 is denoted by P2 (=P1+P2−P1). The differential pressure P2 (set pressure) is based on the biasing force of the biasing unit 29 and does not contain the external pressure P1. Therefore, even if the external pressure P1 changes, the differential pressure P2 that is constant can prevent a gas or a liquid, such as outside seawater, from getting into the space in the stirring device 21.

Then, the fluid 12 stored in this space is transferred through the communication pipe 15 to the second chamber 20 of the first tank 13 or the second tank 14. The total pressure P3 (=P1+P2) applied to the fluid 12 stored in this space is transmitted to both the first and second tanks 13 and 14 through a gap between the rotor and the stator. With this, as with the stirring device 21, the pressure P3 can prevent a gas or a liquid, such as outside seawater, from getting into the communication pipe 15, the first tank 13, the second tank 14, and a storage tank 33. Therefore, the fluid 12 can be surely transferred by using the fluid transfer device 11, and the position of the center of gravity of the first and second tanks 13 and 14 can be quickly, accurately moved.

Similarly, even in a case where the stirring device 21, the communication pipe 15, and the first and second tanks 13 and 14 contract or expand by, for example, an ambient temperature change, the pressure adjuster 24 can adjust the pressure P3 in the stirring device 21, the communication pipe 15, and the first and second tanks 13 and 14 such that the pressure P3 becomes higher than the external pressure P1 by the predetermined set pressure P2. With this, the same effects as above can be obtained.

Next, the transfer portion 16 will be explained in reference to FIG. 1. When the incompressible fluid 17 is supplied to a desired one of the first chambers 19 of the first and second tanks 13 and 14, the transfer portion 16 can discharge the incompressible fluid 17 from the other first chamber 19. The transfer portion 16 includes a supply pump 34, a direction switching valve 35, and the storage tank 33. For example, the supply pump 34, the direction switching valve 35, and the storage tank 33 are provided outside the submersible vessel.

The supply pump 34 shown in FIG. 1 is, for example, a positive-displacement pump and is rotated by an electric motor in a predetermined direction. A discharge port of the supply pump 34 is connected to a P port of the direction switching valve 35 through a supply pipe 36, and a suction port of the supply pump 34 is connected to the storage tank 33 through a supply pipe 37. The storage tank 33 stores the incompressible fluid 17 in a sealed state.

A T port of the direction switching valve 35 is connected to the storage tank 33 through a discharge pipe 38. An A port of the direction switching valve 35 is connected to a hollow guide portion 41 through a supply-discharge pipe 39. The guide portion 41 is provided so as to be fixed to an upper wall 13*a* of the first tank 13, and an internal space 41*a* of the guide portion 41 is sealed off from the outside and communicates with the first chamber 19 of the first tank 13.

A B port of the direction switching valve 35 is connected to the hollow guide portion 41 through the supply-discharge pipe 40. The guide portion 41 is provided so as to be fixed to an upper wall 14*b* of the second tank 14. The internal space 41*a* of the guide portion 41 is sealed off from the outside and communicates with the first chamber 19 of the second tank 14. Then, filters 42 are respectively provided at the supply-discharge pipes 39 and 40.

Further, as shown in FIG. 1, rods 43 are respectively provided in the internal spaces 41*a* of the guide portions 41 of the first and second tanks 13 and 14. Each of the rods 43 is provided so as to be movable in an upper-lower direction along the internal space 41 a of the guide portion 41. Dividing wall holding portions 44 each having, for example, a disc shape are substantially horizontally provided so as to be respectively fixed to lower end portions of the rods 43. Each dividing wall holding portion 44 is provided so as to be coupled to the dividing wall 18. Linear motion bearings are respectively provided at the rods 43.

Each of chain double-dashed lines in the first and second tanks 13 and 14 shown in FIG. 1 shows a state where the dividing wall holding portion 44 and the rod 43 are moved to an upper position or a lower position. When the dividing wall holding portion 44 moves up or down, the dividing wall 18 moves up (to form an inverted cup shape) or down (to form a cup shape).

When the incompressible fluid 17 in the first chamber 19 or the fluid 12 in the second chamber 20 in each of the first and second tanks 13 and 14 increases or decreases, the dividing wall holding portion 44 causes a middle portion of the dividing wall 18 to move up or down in a substantially horizontal state. To be specific, the dividing wall holding portion 44 prevents the dividing wall 18 form closing the supply-discharge holes 46 of the first chamber 19 or the second chamber 20 when the middle portion of the dividing wall 18 is bent and deformed.

As shown in FIG. 1, when a spool of the direction switching valve 35 is located at a left position, the P port and the A port are connected to each other, and the T port and the B port are connected to each other, so that the incompressible fluid 17 ejected through the discharge port of the supply pump 34 can be supplied to the first chamber 19 of the first tank 13 through the supply pipe 36, the supply-discharge pipe 39, and the internal space 41*a* of the guide portion 41.

Then, the incompressible fluid 17 stored in the first chamber 19 of the second tank 14 can be discharged to the storage tank 33 through the internal space 41*a* of the guide portion 41, the supply-discharge pipe 40, and the discharge pipe 38.

When the spool of the direction switching valve 35 is switched to a right position, not shown, the P port and the B port are connected to each other, and the T port and the A port are connected to each other, so that the incompressible fluid 17 ejected from the discharge port of the supply pump 34 can be supplied to the first chamber 19 of the second tank 14 through the supply pipe 36, the supply-discharge pipe 40, and the internal space 41 a of the guide portion 41.

Then, the incompressible fluid 17 stored in the first chamber 19 of the first tank 13 can be discharged to the storage tank 33 through the internal space 41*a* of the guide portion 41, the supply-discharge pipe 39, and the discharge pipe 38.

Next, the fluid 12 will be explained. The fluid 12 is prepared by mixing a semisolid or a paste (such as grease) with metal fine powder, and the specific gravity thereof is 5 to 9, preferably 6.5 to 9. The weight ratio of the semisolid or paste to the metal fine powder is 15:85 to 5:95, preferably, substantially 10:90.

Since the fluid 12 is prepared by mixing the semisolid or paste (such as grease) of high viscosity with the metal fine powder as above, the metal fine powder can be adequately prevented from settling out in the semisolid or paste, and variations in the specific gravity and viscosity in the fluid 12 can be reduced.

By adopting the metal fine powder, the fluid 12 having the specific gravity of 5 to 9 can be prepared. For example, in a case where the fluid transfer device 11 is applied to a submersible vessel that is small in the entire length, the attitude control, such as the front-rear inclination or the left-right inclination, of the vessel can be performed by setting the specific gravity of the fluid 12 to 5 or more.

In addition, since the weight ratio of the semisolid or paste (such as grease) to the metal fine powder is set to 15:85 to 5:95, preferably, substantially 10:90, the metal fine powder in the semisolid or paste can be prevented from settling out. As a result, as described above, the attitude control of the vessel can be performed, and the flowability of the fluid 12 can be secured such that the fluid 12 can move between the first and second tanks 13 and 14.

The metal fine powder is made of tungsten metal whose particle diameter is 10 to 150 μm, preferably 10 to 53 μm. For example, lithium grease is adopted as the semisolid or paste. The specific gravity of the tungsten metal is, for example, about 19.3.

As above, by adopting the metal fine powder whose particle diameter is 10 to 150 μm, preferably 10 to 53 μm, the fluid 12 of high specific gravity can be prepared.

To be specific, if the particle diameter is smaller than 10 μm, the aggregation of the fine powder easily occurs. Since gaps are formed among the aggregates of the fine powder, the specific gravity of the fluid 12 cannot be increased. If the particle diameter exceeds 150 μm, gaps among the fine powder particles are large, so that the specific gravity of the fluid 12 cannot be increased.

The tungsten metal is used as the metal fine powder, and the lithium grease is used as the semisolid or paste, so that the fluid 12 can be provided, which is high in the specific gravity, is stable at normal temperature under atmospheric pressure environment, hardly influences human bodies and nature, and is inexpensive.

Next, the actions of the fluid transfer device 11 configured as above will be explained. The following will explain a case where the fluid 12 stored in the second chamber 20 of the first tank 13 shown on the left side in FIG. 1 is transferred to the second chamber 20 of the second tank 14 shown on the right side in FIG. 1 when the fluid transfer device 11 shown in FIG. 1 is activated to perform the attitude control of, for example, a submersible vessel.

First, the master valve 31 of the pressure adjuster 24 is closed. With this, the fluid 12 can be prevented from flowing in and out from the second pressure adjusting pipe 26. Thus, the transfer efficiency and transfer flow rate accuracy of the fluid 12 can be improved. Next, as shown in FIG. 1, the spool of the direction switching valve 35 is moved to the left position, the supply pump 34 is driven, and the stirring device 21 is driven in a normal direction. The transfer of the fluid 12 in the communication pipe 15 from the first tank 13 side to the second tank 14 side can be assisted by driving the stirring device 21 in the normal direction.

In this state, the incompressible fluid 17 ejected through the discharge port of the supply pump 34 can be supplied to the first chamber 19 of the first tank 13. As the volume of the incompressible fluid 17 in the first chamber 19 of the first tank 13 increases, the dividing wall 18 of the first tank 13 deforms to move from the first chamber 19 side toward the second chamber 20 side. Thus, the volume of the second chamber 20 of the first tank 13 decreases. With this, the fluid 12 stored in the second chamber 20 of the first tank 13 can be transferred through the communication pipe 15 to the second chamber 20 of the second tank 14. At this time, as the volume of the fluid 12 in the second chamber 20 of the second tank 14 increases, the dividing wall 18 of the second tank 14 deforms to move from the second chamber 20 side to the first chamber 19 side. Thus, the volume of the first chamber 19 of the second tank 14 decreases. With this, the incompressible fluid 17 stored in the first chamber 19 of the second tank 14 is discharged from the first chamber 19 to be returned to the storage tank 33.

As above, the fluid 12 having a desired weight and higher specific gravity than the incompressible fluid 17 is transferred from the second chamber 20 of the desired first tank 13 to the second chamber 20 of the second tank 14. With this, the position of the center of gravity of the first and second tanks 13 and 14 can be moved from the first tank 13 side to the second tank 14 side by a desired distance. These position of the center of gravity after this movement is determined based on the total weight of the fluid 12 and the incompressible fluid 17 stored in the first tank 13 and the total weight of the fluid 12 and the incompressible fluid 17 stored in the second tank 14.

After that, at a desired timing, the supply pump 34 is stopped, and the master valve 31 is opened. With this, the pressure adjuster 24 can function to prevent a gas or a liquid, such as outside seawater, from getting into the stirring device 21, the communication pipe 15, the first tank 13, the second tank 14, and the storage tank 33.

Next, the following will explain a case where the fluid 12 stored in the second chamber 20 of the second tank 14 shown on the right side in FIG. 1 is transferred to the second chamber 20 of the first tank 13 shown on the left side in FIG. 1.

First, as with the above, the master valve 31 of the pressure adjuster 24 is closed, and the spool of the direction switching valve 35 is moved to the right position, although not shown. Then, the supply pump 34 is driven, and the stirring device 21 is driven in a reverse direction. The transfer of the fluid 12 in the communication pipe 15 from the second tank 14 side to the first tank 13 side can be assisted by driving the stirring device 21 in the reverse direction.

After that, the incompressible fluid 17 and the fluid 12 are transferred in a direction opposite to the above. With this, the fluid 12 of a desired weight can be transferred from the second chamber 20 of the desired second tank 14 to the second chamber 20 of the first tank 13. With this, the position of the center of gravity of the first and second tanks 13 and 14 can be moved from the second tank 14 side to the first tank 13 side by a desired distance.

In the fluid transfer device 11, the incompressible fluid 17 that is lower in the specific gravity and viscosity than the fluid 12 is adopted. Therefore, the transfer portion 16 can efficiently supply the incompressible fluid 17 to the first chambers 19 of the first and second tanks 13 and 14 and discharge the incompressible fluid 17 from the first chambers 19 of the first and second tanks 13 and 14. On this account, the fluid 12 having the high specific gravity and viscosity and stored in the second chamber 20 of a desired one of the first and second tanks 13 and 14 can be efficiently transferred to the second chamber 20 of the other tank.

Since the first chamber 19 and the second chamber 20 are separated by the dividing wall 18 made of deformable synthetic rubber, the fluid 12 and the incompressible fluid 17 in the first and second tanks 13 and 14 do not mix with each other. Therefore, the position of the center of gravity of the first and second tanks 13 and 14 can be accurately moved to a desired tank side.

Further, the fluid 12 has higher viscosity than the incompressible fluid 17. Therefore, the fine powder contained in the fluid 12 and having high specific gravity can be prevented from settling out in the fluid 12, and the variations in the specific gravity in the fluid 12 can be reduced. On this account, the movement accuracy of the position of the center of gravity of the tanks 13 and 14 and the weight accuracy of the fluid 12 to be moved can be improved.

Therefore, for example, in a case where the fluid transfer device 11 is used in a ship, such as a submersible vessel, the attitude control can be performed by quickly, accurately moving the position of the center of gravity of the submersible vessel or the like. One example of the attitude control is the front-rear inclination performed when the submersible vessel submerges or rises. The front-rear inclination is quickly performed to realize a correct inclination angle. With this, the submersible vessel can quickly submerge or rise by using a small amount of propulsive power generated by a propulsive driving portion.

The reason why the submersible vessel can quickly submerge or rise by using a small amount of propulsive power generated by the propulsive driving portion is because a propulsive vector and a proceeding direction of the vessel can be caused to coincide with each other or be set close to each other. With this, the effective utilization of the propulsive energy can be realized.

Another example of the attitude control is the left-right inclination caused by transportable heavy loads (burdens and the like), crew members, and the like in a ship, such as a submersible vessel. The left-right inclination of the ship is performed quickly to realize a correct inclination angle. With this, the left-right balance of the ship can be quickly, safely adjusted.

Another object of the attitude control is to correct the attitude (moment balance) of the ship by loaded goods of a ship, such as a submersible vessel.

Further, when the fluid 12 is transferred, the deformable dividing walls 18 provided in the first and second tanks 13 and 14 deform by receiving the pressure of the incompressible fluid 17. Since the dividing wall 18 is not configured to deform by pressing a hard member against a part of the dividing wall 18, the life of the dividing wall 18 to be deformed can be extended. As a result, the fluid transfer device 11 having excellent durability can be provided.

By supplying the incompressible fluid 17 of comparatively low viscosity to the first chambers 19 of the first and second tanks 13 and 14 and discharging the incompressible fluid 17 from the first chambers 19 of the first and second tanks 13 and 14, the fluid 12 of comparatively high viscosity stored in the second chamber 20 via the dividing wall 18 is transferred. Therefore, the energy used for the transfer can be made smaller than, for example, a case where the fluid 12 of comparatively high viscosity is directly transferred by using a pump.

To move the position of the center of gravity of the submersible vessel or the like as above, it is effective to use mercury as the fluid 12 since the mercury has high specific gravity. However, by using the fluid 12 of high specific gravity containing the fine powder of high specific gravity according to the present embodiment, the position of the center of gravity can be quickly, surely moved without using the mercury.

While stirring the fluid 12 transferred through the communication pipe 15, the stirring device 21 shown in FIG. 1 can transfer the fluid 12. Therefore, the ejecting pressure of the incompressible fluid 17 supplied to the first chamber 19 by the supply pump 34 to transfer the fluid 12 can be reduced. Thus, the fluid 12 can be transferred smoothly.

In the above embodiment, as shown in FIG. 1, the pressure adjuster 24 is connected to the stirring device 21 through the first and second pressure adjusting pipes 25 and 26. However, instead of this, the pressure adjuster 24 may be connected to the communication pipe 15 through the first and second pressure adjusting pipes 25 and 26.

A branching joint may be provided on the first pressure adjusting pipe 25 extending between the master valve 31 and pressure transducer 32 of the pressure adjuster 24 shown in FIG. 1, and the branching joint may be connected to the storage tank 33 and the first chambers 19 of the first and second tanks 13 and 14 through another first pressure adjusting pipe. With this, each of the internal pressures of the storage tank 33 and the first and second tanks 13 and 14 can be accurately adjusted so as to be higher than an external pressure by the predetermined set pressure P2.

Further, in the above embodiment, as shown in FIG. 1, the first and second tanks 13 and 14 are provided so as to be spaced apart from each other in a substantially horizontal direction, and the center of gravity of the first and second tanks 13 and 14 is moved in a straight direction. However, in addition to this, another fluid transfer device 11 having the same configuration as in FIG. 1 may be additionally provided such that the position of the center of gravity of the first and second tanks 13 and 14 can be moved in a substantially horizontal direction perpendicular to the straight direction in which the first and second tanks 13 and 14 are provided. With this, the position of the center of gravity of a ship, such as a submersible vessel, can be moved in directions within a two-dimensional region. With this, the attitude control of a three-dimensional motion of, for example, a submersible vessel can be performed.

In the above embodiment, the fluid transfer device 11 is applied to the submersible vessel. However, the fluid transfer device 11 is applicable to ships other than the submersible vessel. The fluid transfer device 11 is also applicable to vehicles, land structures, and the like in addition to the ships and can move the position of the center of gravity of each of those vehicles, land structures, and the like.

INDUSTRIAL APPLICABILITY

As above, according to the fluid transfer device of the present invention, the ship including the fluid transfer device, and the fluid for use in the transfer device, the fluid of high specific gravity and viscosity stored in a desired one of two tanks can be quickly transferred to the other tank with high flow rate accuracy, and the fluid transfer device has excellent durability. Thus, the present invention is suitably applied to the fluid transfer device, the ship including the fluid transfer device, and the fluid for use in the transfer device.

REFERENCE SIGNS LIST

11 fluid transfer device
12 fluid
13 first tank
13*a* bottom wall
13*b* upper wall
14 second tank
14*a* bottom wall
14*b* upper wall

15 communication pipe
16 transfer portion
17 incompressible fluid
18 dividing wall
19 first chamber
20 second chamber
21 stirring device
21*a* exterior portion
22 first opening portion
23 second opening portion
24 pressure adjuster
25 first pressure adjusting pipe
26 second pressure adjusting pipe
27 cylinder portion
28 piston portion
29 biasing unit (compression coil spring)
30, 42 filter
31 master valve
32 pressure transducer
32*a* outer case
33 storage tank
34 supply pump
35 direction switching valve
36, 37 supply pipe
38 discharge pipe
39, 40 supply-discharge pipe
41 guide portion
41*a* internal space
43 rod
44 dividing wall holding portion
45 linear motion bearing
46 supply-discharge hole

The invention claimed is:

1. A fluid transfer device comprising:

first and second tanks each configured to store a fluid containing fine powder;

a communication pipe through which the first and second tanks communicate with each other; and a transfer portion configured to transfer the fluid stored in the first tank to the second tank and transfer the fluid stored in the second tank to the first tank, wherein:

each of the first and second tanks includes a first chamber and a second chamber that are separated by a deformable dividing wall;

each of the first chambers stores an incompressible fluid;

each of the second chambers stores the fluid having higher specific gravity and viscosity than the incompressible fluid;

the second chambers of the first and second tanks communicate with each other through the communication pipe;

when the transfer portion supplies the incompressible fluid to a desired one of the first chambers, the incompressible fluid is discharged from the other first chamber;

a stirring device configured to stir the fluid in the communication pipe is provided on the communication pipe;

a pressure adjuster is provided at the stirring device or the communication pipe; and the pressure adjuster includes a cylinder portion configured to cause an inner side and outer side of the stirring device or the communication pipe to communicate with each other, a piston portion provided in the cylinder portion, and a biasing unit configured to bias the piston portion such that pressure in the stirring device or the communication pipe increases.

2. The fluid transfer device according to claim 1, wherein the stirring device is a uniaxial eccentric screw pump.

3. The fluid transfer device according to claim 1, wherein:

the fluid is prepared by mixing metal fine powder and one of a semisolid and a paste;

the specific gravity of the fluid is 5 to 9; and a weight ratio of the semisolid or paste to the metal fine powder is 15:85 to 5:95.

4. The fluid transfer device according to claim 3, wherein:

the metal fine powder is tungsten metal whose particle diameter is 10 to 150 μm; and the semisolid or paste is lithium grease.

5. A ship comprising the fluid transfer device according to claim 1.

* * * * *